US011951590B2

(12) United States Patent
Wewala Gonnagahadeniyage et al.

(10) Patent No.: US 11,951,590 B2
(45) Date of Patent: Apr. 9, 2024

(54) POLISHING PADS WITH INTERCONNECTED PORES

(71) Applicant: Applied Materials, Inc., Santa Clara, CA (US)

(72) Inventors: Shiyan Akalanka Jayanath Wewala Gonnagahadeniyage, Santa Clara, CA (US); Ashwin Chockalingam, Santa Clara, CA (US); Jason Garcheung Fung, Santa Clara, CA (US); Veera Raghava Reddy Kakireddy, Santa Clara, CA (US); Nandan Baradanahalli Kenchappa, San Jose, CA (US); Puneet Narendra Jawali, San Jose, CA (US); Rajeev Bajaj, Fremont, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 198 days.

(21) Appl. No.: 17/346,399

(22) Filed: Jun. 14, 2021

(65) Prior Publication Data

US 2022/0395958 A1 Dec. 15, 2022

(51) Int. Cl.
*B24B 37/26* (2012.01)

(52) U.S. Cl.
CPC ..... *B24B 37/26* (2013.01)

(58) Field of Classification Search
CPC ..... B24B 37/20; B24B 37/24; B24B 37/245; B24B 37/26; B24D 3/20; B24D 3/28; B24D 3/32; B24D 3/285
See application file for complete search history.

(56) References Cited

U.S. PATENT DOCUMENTS

| | | | |
|---|---|---|---|
| 9,669,512 | B2 | 6/2017 | Bajaj et al. |
| 9,776,361 | B2 | 10/2017 | Krishnan et al. |
| 9,873,180 | B2 | 1/2018 | Bajaj et al. |
| 10,322,491 | B2 | 6/2019 | Orilall et al. |
| 10,384,330 | B2 | 8/2019 | Bajaj et al. |
| 10,391,605 | B2 | 8/2019 | Ganapathiappan et al. |

(Continued)

FOREIGN PATENT DOCUMENTS

| | | | | |
|---|---|---|---|---|
| CN | 112720282 A | * | 4/2021 | ..... B24D 7/00 |
| CN | 112757154 A | * | 5/2021 | ..... B24B 37/26 |

(Continued)

OTHER PUBLICATIONS

English translation of CN112757154A (Year: 2021).*

(Continued)

*Primary Examiner* — Laura C Guidotti
*Assistant Examiner* — Sukwoo James Chang
(74) *Attorney, Agent, or Firm* — Patterson + Sheridan, LLP

(57) ABSTRACT

Embodiments herein generally relate to polishing pads and methods of forming polishing pads. A polishing pad includes a plurality of polishing elements and a plurality of grooves disposed between the polishing elements. Each polishing element includes a plurality of individual posts. Each post includes an individual surface that forms a portion of a polishing surface of the polishing pad and one or more sidewalls extending downwardly from the individual surface. The sidewalls of the plurality of individual posts define a plurality of pores disposed between the posts.

20 Claims, 11 Drawing Sheets

(56) References Cited

U.S. PATENT DOCUMENTS

| | | | |
|---|---|---|---|
| 10,399,201 | B2 | 9/2019 | Ganapathiappan et al. |
| 10,456,886 | B2 | 10/2019 | Ganapathiappan et al. |
| 10,493,691 | B2 | 12/2019 | Krishnan et al. |
| 10,537,974 | B2 | 1/2020 | Bajaj et al. |
| 10,593,574 | B2 | 3/2020 | Fung et al. |
| 10,618,141 | B2 | 4/2020 | Chockalingam et al. |
| 10,773,509 | B2 | 9/2020 | Ng et al. |
| 10,821,573 | B2 | 11/2020 | Bajaj et al. |
| 10,875,145 | B2 | 12/2020 | Bajaj et al. |
| 10,875,153 | B2 | 12/2020 | Bajaj et al. |
| 10,919,123 | B2 | 2/2021 | Hariharan et al. |
| 10,953,515 | B2 | 3/2021 | Ganapathiappan et al. |
| 2006/0073768 | A1 | 4/2006 | Mavliev et al. |
| 2008/0248734 | A1 | 10/2008 | Bajaj |
| 2009/0137121 | A1 | 5/2009 | Hsu et al. |
| 2010/0105303 | A1* | 4/2010 | Chiu ..... B24B 37/26 451/548 |
| 2012/0178348 | A1 | 7/2012 | Hsu et al. |
| 2016/0101500 | A1 | 4/2016 | Fung et al. |
| 2017/0203408 | A1 | 7/2017 | Ganapathiappan et al. |
| 2018/0339397 | A1* | 11/2018 | Redfield ..... B29C 64/129 |
| 2019/0030678 | A1 | 1/2019 | Kumar et al. |
| 2019/0039204 | A1 | 2/2019 | Chockalingam et al. |
| 2019/0047112 | A1 | 2/2019 | Fu et al. |
| 2019/0202024 | A1 | 7/2019 | Ganapathiappan et al. |
| 2019/0224809 | A1 | 7/2019 | Ganapathiappan et al. |
| 2019/0299357 | A1 | 10/2019 | Orilall et al. |
| 2019/0299537 | A1 | 10/2019 | McClintock et al. |
| 2019/0337117 | A1 | 11/2019 | Ganapathiappan et al. |
| 2019/0381630 | A1 | 12/2019 | Wang et al. |
| 2020/0001433 | A1 | 1/2020 | Bajaj et al. |
| 2020/0055161 | A1 | 2/2020 | Chockalingham et al. |
| 2020/0070302 | A1 | 3/2020 | Ganapathiappan et al. |
| 2020/0101657 | A1 | 4/2020 | Krishnan et al. |
| 2020/0135517 | A1 | 4/2020 | Fung et al. |
| 2020/0147750 | A1 | 5/2020 | Bajaj et al. |
| 2020/0230781 | A1 | 7/2020 | Chockalingam et al. |
| 2020/0299834 | A1 | 9/2020 | Bajaj et al. |
| 2020/0325353 | A1 | 10/2020 | Sridhar et al. |
| 2021/0107116 | A1 | 4/2021 | Bajaj et al. |

FOREIGN PATENT DOCUMENTS

| | | | | |
|---|---|---|---|---|
| WO | 2017053737 | A1 | 3/2017 | |
| WO | WO2020242110 | A1 * | 3/2020 | ..... H01L 21/67 |
| WO | WO2020242172 | A1 * | 3/2020 | ..... H01L 21/67 |

OTHER PUBLICATIONS

English translation of WO2020242110A1 (Year: 2020).*
English translation of WO2020242172A1 (Year: 2020).*
English translation of CN112720282A (Year: 2021).*
U.S. Appl. No. 17/321,694, filed May 17, 2021.
U.S. Appl. No. 16/906,992, filed Jun. 19, 2020.
International Search Report and Written Opinion dated Sep. 8, 2022 for Application No. PCT/US2022/030549.

* cited by examiner

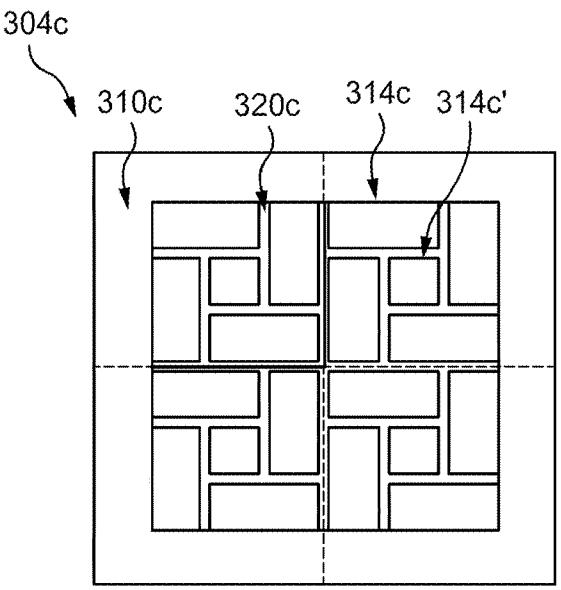
FIG. 3C
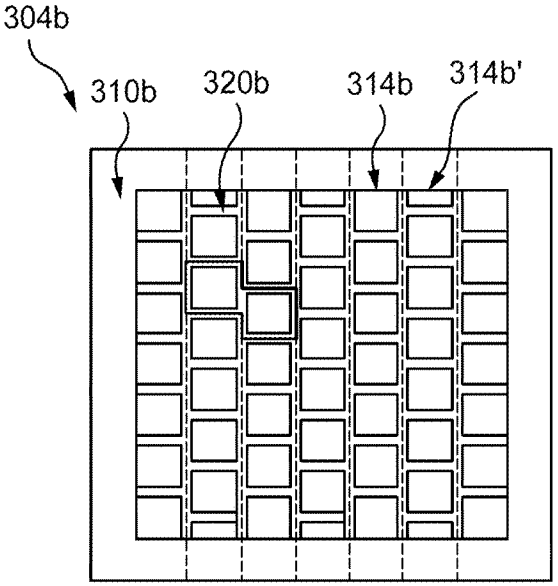
FIG. 3B
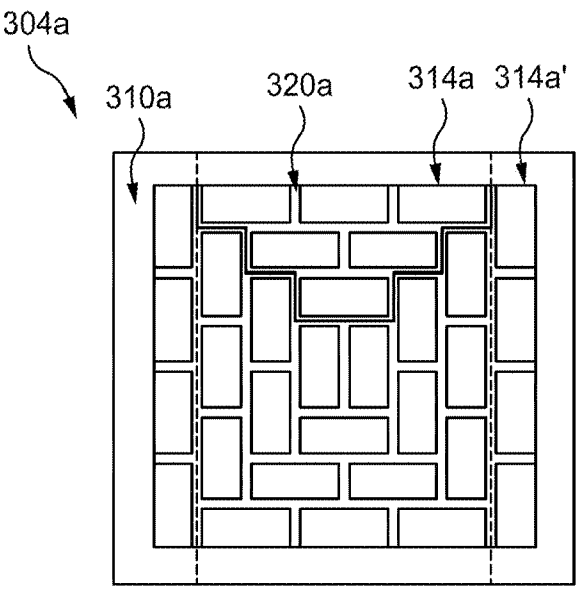
FIG. 3A
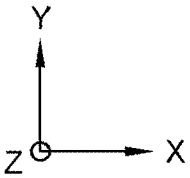

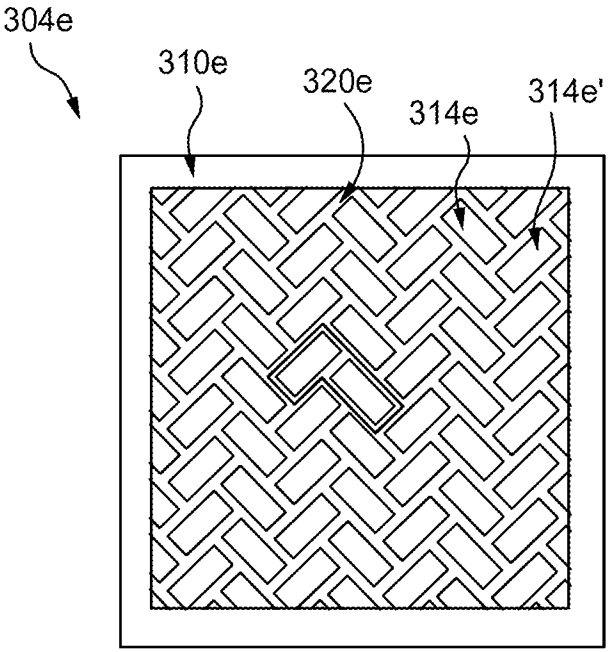
FIG. 3E
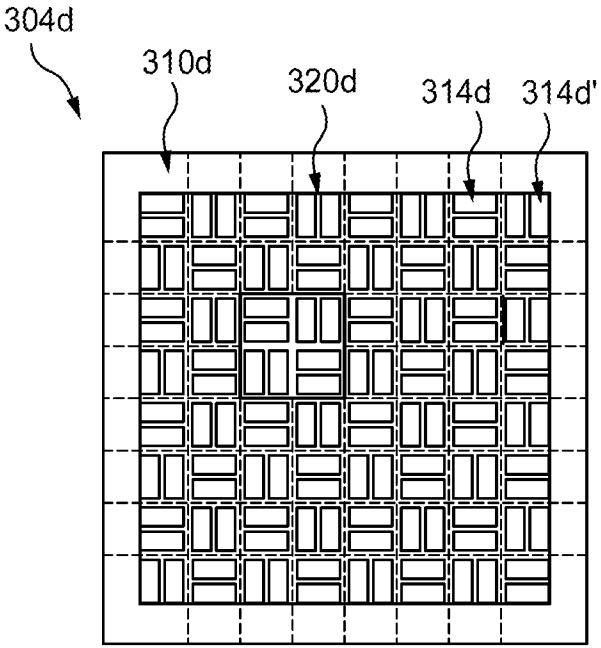
FIG. 3D
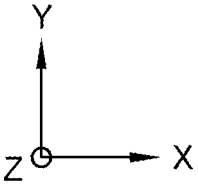

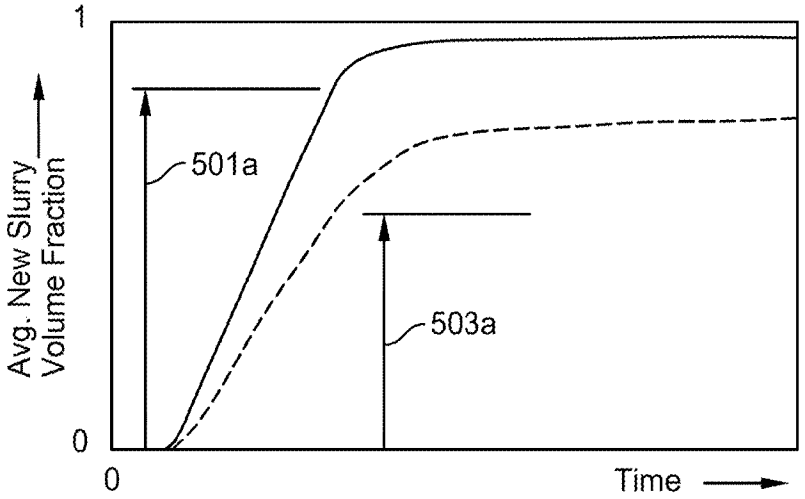
FIG. 5A
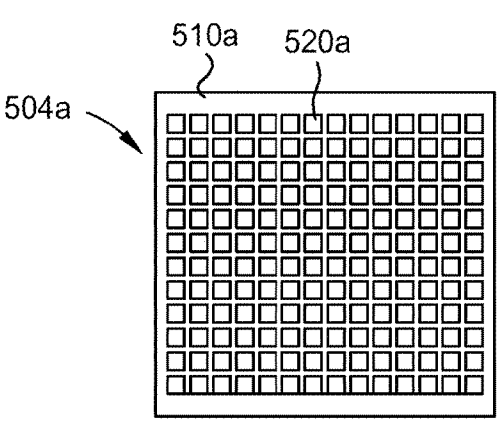
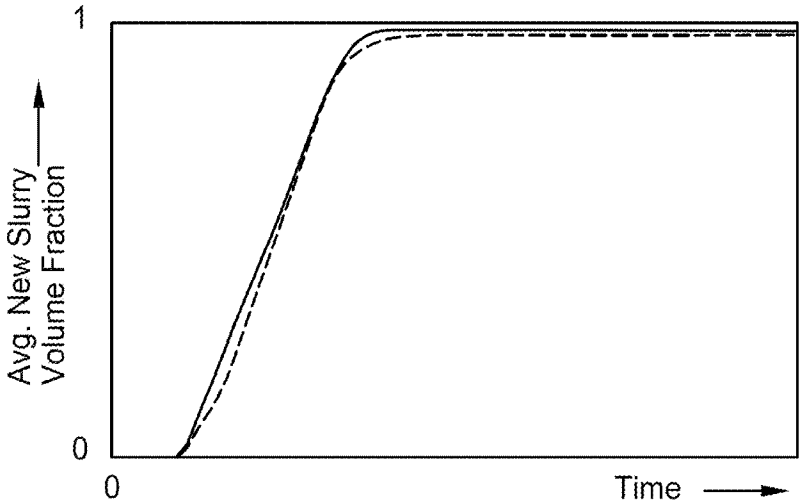
FIG. 5B
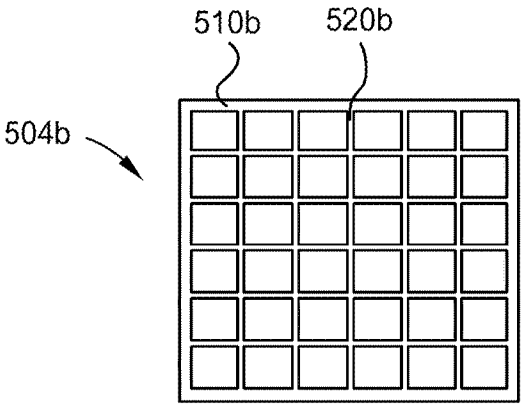

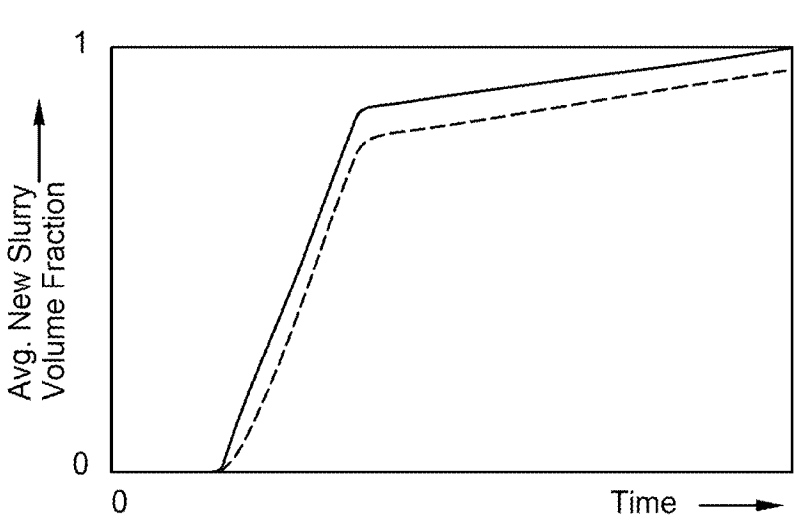
FIG. 5C
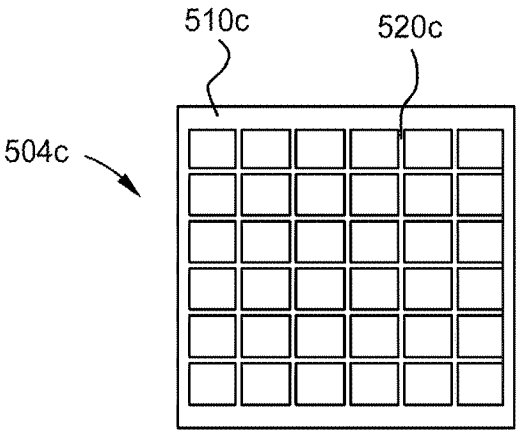
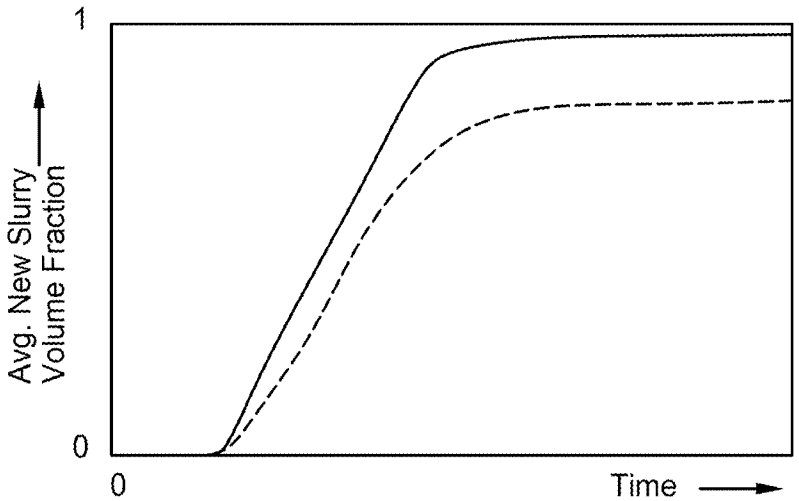
FIG. 5D
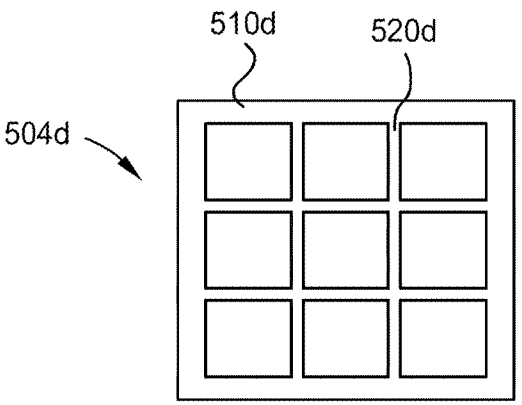

POLISHING PADS WITH INTERCONNECTED PORES

BACKGROUND

Field

Embodiments of the present disclosure generally relate to polishing pads, and methods of manufacturing polishing pads, and more particularly, to polishing pads used for chemical mechanical polishing (CMP) of a substrate in an electronic device fabrication process.

Description of the Related Art

Chemical mechanical polishing (CMP) is commonly used in the manufacturing of high-density integrated circuits to planarize or polish a layer of material deposited on a substrate. A typical CMP process includes contacting the material layer to be planarized with a polishing pad and moving the polishing pad, the substrate, or both, and hence creating relative movement between the material layer surface and the polishing pad, in the presence of a polishing fluid including abrasive particles, known as a slurry. Material is removed across the material layer surface of the substrate in contact with the polishing pad through a combination of chemical and mechanical activity which is provided by the polishing fluid, abrasive particles, and relative motion of the substrate and the polishing pad.

During polishing, material removed from the substrate may build-up on the polishing pad, which is known as debris loading. For example, build-up may occur on a polishing surface of the polishing pad and/or within pores of the polishing pad. Increased levels of debris loading may result in lower CMP removal rates and higher substrate defectivity. New slurry may be continuously added to the polishing surface to remove and replace the old slurry and thus remove the debris. However, conventional polishing pads may have a high resistance to the flow of slurry which limits slurry transport across the pad, and thus leads to undesirable debris loading.

Accordingly, there is a need in the art for polishing pads with improved slurry transport characteristics and methods of forming the polishing pads.

SUMMARY

Embodiments described herein generally relate to polishing pads, and methods for manufacturing polishing pads which may be used in a chemical mechanical polishing (CMP) process. More particularly, embodiments herein provide for polishing pads with interconnected pores and additive manufacturing methods of forming the polishing pads.

In one embodiment, a polishing pad includes a plurality of polishing elements and a plurality of grooves disposed between the polishing elements. Each polishing element includes a plurality of individual posts. Each post includes an individual surface that forms a portion of a polishing surface of the polishing pad and one or more sidewalls extending downwardly from the individual surface. The sidewalls of the plurality of individual posts define a plurality of pores between the posts. The depth of the pores is about equal to a depth of the grooves.

In another embodiment, a method of forming a polishing pad includes (a) dispensing droplets of a pre-polymer composition onto a surface of a previously formed print layer according to a predetermined droplet dispense pattern. The method includes (b) at least partially curing the dispensed droplets of the pre-polymer composition to form a print layer. The method includes (c) sequentially repeating (a) and (b) to form a plurality of polishing elements. A plurality of grooves are disposed between the polishing elements. Each polishing element includes a plurality of individual posts. Each post includes an individual surface that forms a portion of a polishing surface of the polishing pad and one or more sidewalls extending downwardly from the individual surface. The sidewalls of the plurality of individual posts define a plurality of pores between the posts and a depth of the pores is about equal to a depth of the grooves.

In another embodiment, a method of polishing a substrate includes urging a substrate against a polishing surface of a polishing pad. The polishing pad includes a plurality of polishing elements and a plurality of grooves disposed between the polishing elements. Each polishing element includes a plurality of individual posts. Each post includes an individual surface that forms a portion of a polishing surface of the polishing pad and one or more sidewalls extending downwardly from the individual surface. The sidewalls of the plurality of individual posts define a plurality of pores between the posts and a depth of the pores is about equal to a depth of the grooves.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 3A-3E illustrate exemplary interconnected pore networks viewed from top-down according to embodiments described herein.

FIGS. 5A-5D illustrate top-down views of exemplary polishing elements with either isolated pores or interconnected pores according to embodiments described herein.

Figure 1:
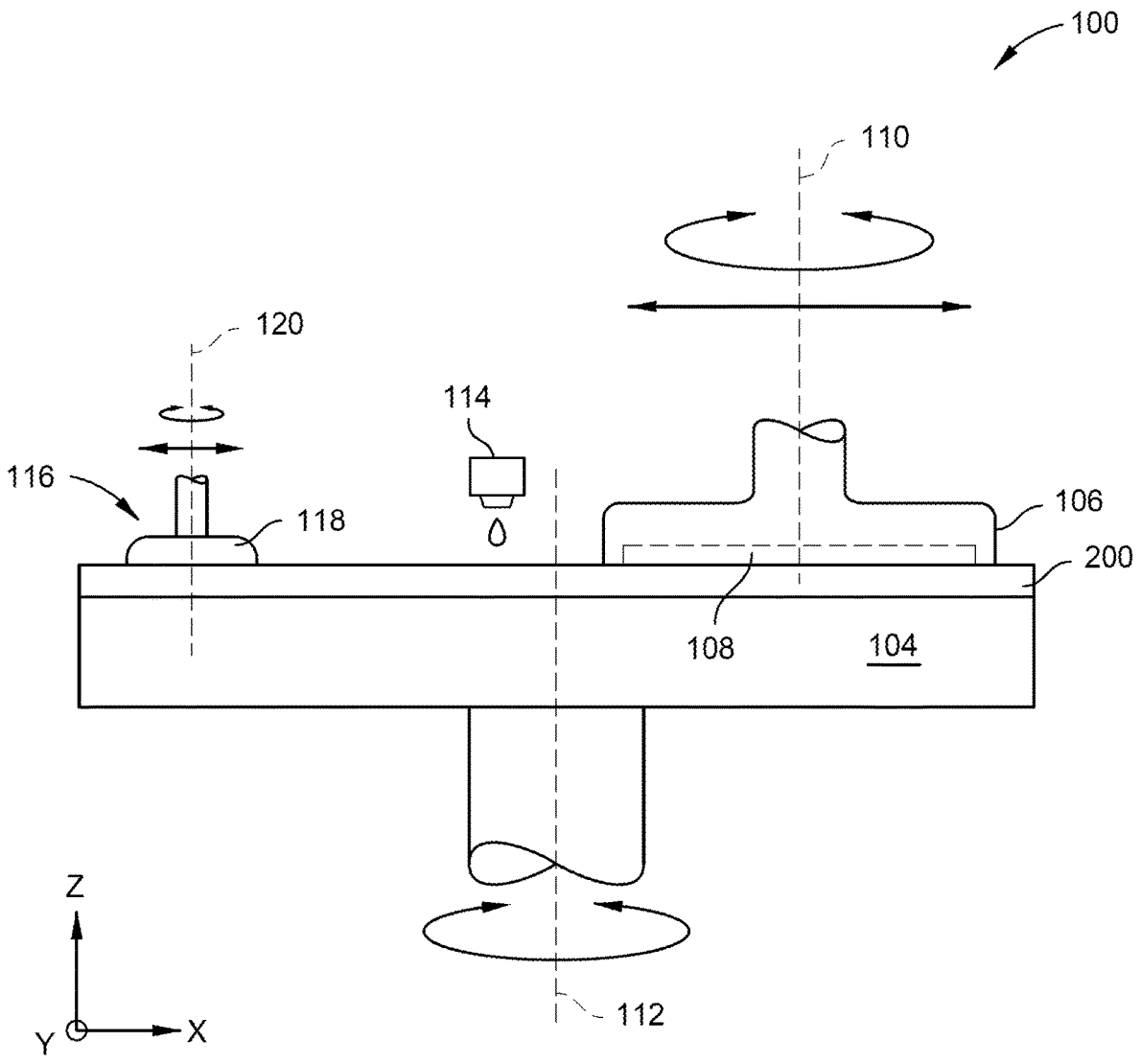
FIG. 1 is a schematic side view of an exemplary polishing system configured to use a polishing pad formed according to embodiments described herein.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Embodiments described herein generally relate to polishing pads, and methods for manufacturing polishing pads, which may be used in a chemical mechanical polishing (CMP) process. In particular, the polishing pads described herein feature interconnected pores.

Embodiments described herein provide polishing pads having polishing elements with interconnected pores which have lower flow resistance to slurry transport (e.g., primary and secondary transport) compared to polishing pads with conventional isolated pores. Therefore, slurry transport through interconnected pores is more efficient (e.g., having faster slurry renewal, or turnover) compared to isolated pores resulting in the old slurry being removed and replaced at a higher rate. In effect, interconnected pores reduce debris loading on the polishing surface. As a result, polishing pads with interconnected pores yield better CMP removal rates and lower substrate defectivity compared to isolated pores.

Embodiments described herein provide polishing pads formed through additive manufacturing, which compared to conventional fabrication techniques, results in pore architectures formed with greater resolution and greater precision.

Embodiments described herein provide polishing pads with micro-level improvement in transport mechanisms (e.g., at the sub-polishing element size scale) in contrast to conventional macro-level modifications in pad design (e.g., polishing element shape, polishing element size, and groove size).

Exemplary Polishing System

FIG. 1 is a schematic side view of an exemplary polishing system 100 configured to use a polishing pad 200 formed according to embodiments described herein. The polishing pad 200 is further described in FIG. 2.

Here, the polishing system 100 features a platen 104, having the polishing pad 200 secured thereto using a pressure sensitive adhesive, and a substrate carrier 106. The substrate carrier 106 faces the platen 104 and the polishing pad 200 mounted thereon. The substrate carrier 106 is used to urge a material surface of a substrate 108, disposed therein, against the polishing surface of the polishing pad 200 while simultaneously rotating about a carrier axis 110. Typically, the platen 104 rotates about a platen axis 112 while the rotating substrate carrier 106 sweeps back and forth from an inner diameter to an outer diameter of the platen 104 to, in part, reduce uneven wear of the polishing pad 200.

The polishing system 100 further includes a fluid delivery arm 114 and a pad conditioner assembly 116. The fluid delivery arm 114 is positioned over the polishing pad 200 and is used to deliver a polishing fluid, such as a polishing slurry having abrasives suspended therein, to a surface of the polishing pad 200. Typically, the polishing fluid contains a pH adjuster and other chemically active components, such as an oxidizing agent, to enable chemical mechanical polishing of the material surface of the substrate 108. The pad conditioner assembly 116 is used to condition the polishing pad 200 by urging a fixed abrasive conditioning disk 118 against the surface of the polishing pad 200 before, after, or during polishing of the substrate 108. Urging the conditioning disk 118 against the polishing pad 200 includes rotating the conditioning disk 118 about a conditioner axis 120 and sweeping the conditioning disk 118 from an inner diameter of the platen 104 to an outer diameter of the platen 104. The conditioning disk 118 is used to abrade and rejuvenate the polishing pad 200 polishing surface, and to remove polish byproducts or other debris from the polishing surface of the polishing pad 200.

Although embodiments described herein are generally related to chemical mechanical polishing (CMP) pads used in semiconductor device manufacturing, the polishing pads and manufacturing methods thereof are also applicable to other polishing processes using both chemically active and chemically inactive polishing fluids and/or polishing fluids free from abrasive particles. In addition, embodiments described herein, alone or in combination, may be used in at least the following industries: aerospace, ceramics, hard disk drive (HDD), MEMS, nano-technology, metalworking, optics and electro-optics manufacturing, and semiconductor device manufacturing, among others.

Polishing Pad Examples

The polishing pads described herein include a foundation layer and a polishing layer disposed on the foundation layer. The polishing layer forms the polishing surface of the polishing pad and the foundation layer provides support for the polishing layer as a to-be-polished substrate is urged thereagainst. The foundation layer and the polishing layer are formed of different pre-polymer compositions that, when cured, have different material properties. The foundation layer and the polishing layer are integrally and sequentially formed using a continuous layer-by-layer additive manufacturing process. The additive manufacturing process provides a polishing pad body having a continuous polymer phase between the polishing layer and the foundation layer thus eliminating the need for an adhesive layer or other bonding method therebetween. In some embodiments, the polishing layer is formed of a plurality of polishing elements, which are separated from one another across the polishing surface by grooves, or channels, disposed therebetween. In some embodiments, the polishing material of the polishing pad may be formed from different pre-polymer compositions, or different ratios of the different pre-polymer compositions, to provide unique material properties.

Generally, the methods set forth herein use an additive manufacturing system (e.g., a 2D or 3D inkjet printer system), to form (print) at least portions of the polishing pads in a layer-by-layer process. Typically, each print layer is formed (printed) by sequentially depositing and at least partially curing droplets of desired pre-polymer compositions and/or pore-forming sacrificial material precursor compositions on a manufacturing support or a previously formed print layer. Beneficially, the additive manufacturing system and the methods set forth herein enable at least micron scale droplet placement control within each print layer (X-Y resolution) as well as micron scale (0.1 μm to 200 μm) control over the thickness (Z resolution) of each print layer. The micron scale X-Y and Z resolutions provided by the additive manufacturing systems and the methods set forth herein facilitate the formation of desirable and repeatable patterns of the pores described herein. Thus, in some embodiments, the additive manufacturing methods used to from the polishing pads also impart one or more distinctive structural characteristics to the polishing pads formed therefrom.

Figure 2A:
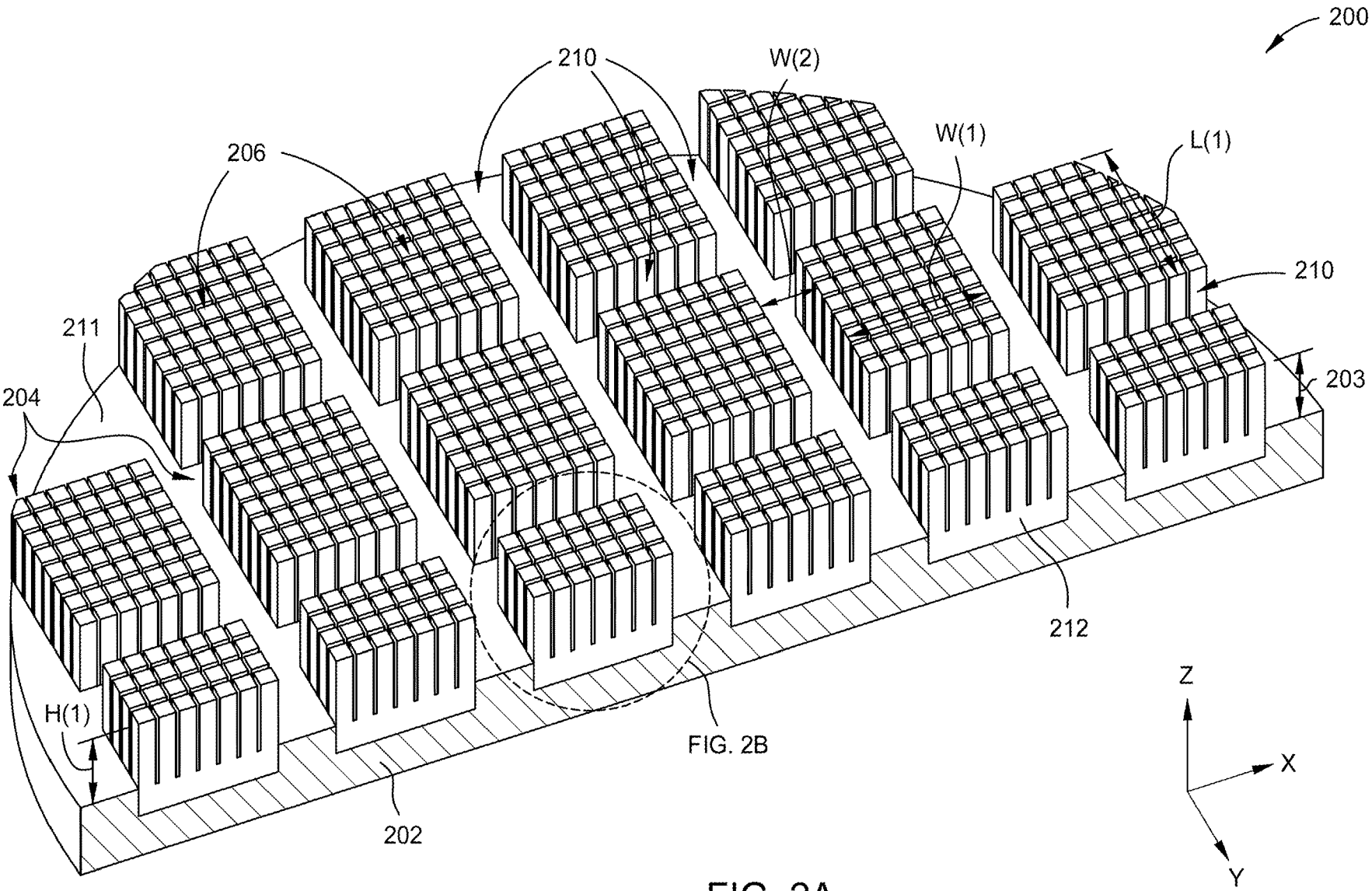
FIG. 2A is a schematic isometric sectional view of a polishing pad featuring interconnected pores according to embodiments described herein.

FIG. 2A is a schematic isometric sectional view of a polishing pad 200 featuring interconnected pores according to embodiments described herein, which may be formed using the methods set forth herein. Here, the polishing pad 200 includes a foundation layer 202 and a polishing layer 203 disposed on the foundation layer 202 and integrally formed therewith using an additive manufacturing process. The additive manufacturing process allows for co-polymerization of different pre-polymer compositions used to respectively form the foundation layer 202 and the polishing layer 203, thus providing a continuous phase of polymer material across the interfacial boundary regions therebetween.

Here, the polishing layer 203 is formed of a plurality of polishing elements 204 that extend upwardly from the foundation layer 202 to form a polishing surface 206. The plurality of polishing elements 204 are spaced apart from one another to define a plurality of grooves 210 therebetween. The plurality of grooves 210 are disposed between adjacent ones of the plurality of polishing elements 204 and between a plane of the polishing surface 206 and an upward facing surface 211 of the foundation layer 202. The plurality of grooves 210 facilitate the distribution of polishing fluids across the polishing pad 200 and to an interface between the polishing surface 206 and a material surface of a substrate to be polished thereon. The plurality of polishing elements 204 are supported in a thickness direction (Z direction) of the polishing pad 200 by a portion of the foundation layer 202. Thus, when a load is applied to the polishing surface 206 by a substrate urged thereagainst, the load is transmitted through the polishing elements 204 and to the portion of the foundation layer 202 disposed therebeneath.

Here, the plurality of polishing elements 204 are formed to have a substantially rectangular shape (square as shown) when viewed from top-down and are arranged so that the plurality of grooves 210 defined therebetween form an X-Y grid pattern. Alternate shapes and/or arrangements of polishing elements that may be used for the polishing elements 204, and the grooves 210 defined therefrom, are illustrated in FIGS. 4A-4F. In some embodiments, the shapes, dimensions, and/or arrangements of the polishing elements 204, and/or the grooves 210 disposed therebetween, are varied across the polishing pad 200 to tune hardness, mechanical strength, fluid transport characteristics, and/or other desirable properties thereof. As shown in FIG. 2A, the polishing layer 203 is formed of a plurality of discrete polishing elements 204 which are separated from each other by the grooves 210. However, in some other embodiments (not shown), the polishing elements 204 of the polishing layer 203 may be interconnected with each other. In such embodiments, the grooves 210 defined between polishing surfaces of adjacent polishing elements 204 may extend only partially through the polishing layer 203 such that the foundation layer 202 is not exposed within the grooves 210.

As shown, at least a portion of the polishing elements 204 extend through an X-Y plane of the upward facing surface 211 of the foundation layer 202 to a location inwardly of the foundation layer 202, and the remaining portion of the polishing elements 204 extends upwardly or outwardly of the foundation layer 202 by a height H(1) from the X-Y plane of the upward facing surface 211 of the foundation layer 202. The height H(1) of the polishing elements 204 defines a depth of the grooves 210 interposed therebetween. In some embodiments, a height H(1) of the polishing elements 204, and thus the depth of the grooves 210, is about 1 mm or less, such as about 500 μm or less, about 400 μm or less, about 300 μm or less, or about 200 μm or less, or within a range of about 100 μm to about 1 mm, such as about 100 μm to about 500 μm, about 100 μm to about 400 μm, about 100 μm to about 300 μm, or about 100 μm to about 200 μm.

Here, at least one lateral dimension of the polishing elements 204 (e.g., one or both of W(1) and L(1) when viewed from above) is about 5 mm or less, such as about 4 mm less, about 3 mm or less, or about 2 mm or less, or within a range of about 1 mm to about 5 mm, such as about 1 mm to about 4 mm, about 1 mm to about 3 mm, or about 2 mm to about 3 mm. The upper surfaces of the polishing elements 204 are parallel to the X-Y plane and form the polishing surface 206, which together form the total polishing surface of the polishing pad 200. Sidewalls of the polishing elements 204 are substantially vertical (orthogonal to the X-Y plane), such as within about 20° of vertical, or within 10° of vertical. Individual ones of the plurality of polishing elements 204 are spaced apart from one another in the X-Y plane by a width W(2) of the individual grooves 210 defined therebetween. Here, the width W(2) of the individual grooves 210 is about 300 μm or more, such as about 400 μm or more, about 500 μm or more, or about 600 μm or more, or within a range of about 300 μm to about 400 μm, or about 400 μm to about 500 μm, or about 500 μm to about 600 μm. In some embodiments, one or both of the lateral dimensions W(1) and L(1) of the polishing elements 204 and/or the width W(2) of the individual grooves 210 vary across a radius of the polishing pad 200 to allow fine tuning of the polishing performance thereof.

The polishing elements 204 are formed of a continuous polymer phase of polymer material 212. The polymer material 212 may have a relatively low storage modulus E', i.e., a soft pad material, a relatively high storage modulus E', i.e., a hard pad material, or a relatively medium storage modulus E' between the relatively low and relatively high storage modulus, i.e., a medium pad material. In some examples, the polymer material 212 may have a generally homogenous material composition. In some other examples, the polymer material 212 may include at least two pre-polymer compositions, and thus include a combination of low, medium, or high storage modulus E' materials with a difference from one another in one or more material properties. Characterizations of the low, medium, and high storage modulus E' materials at a temperature of about 30° C. (E'30) are summarized in Table 1.

TABLE 1

| | Low Storage Modulus Compositions | Medium Storage Modulus Compositions | High Storage Modulus Compositions |
|---|---|---|---|
| E'30 | <100 MPa, (e.g., 1MPa-100 MPa) | 100 MPa-500 MPa | >500 MPa (e.g., 500 MPa-3000 MPa) |

Figure 2C:
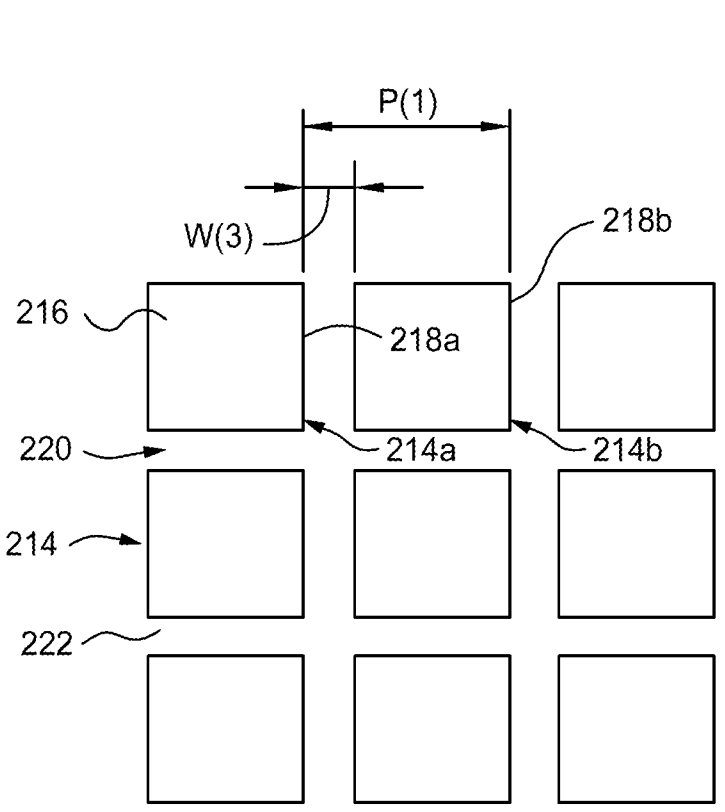
FIG. 2C is a close-up, top-down view of a portion of the polishing pad of FIG. 2A according to embodiments described herein.
Figure 2B:
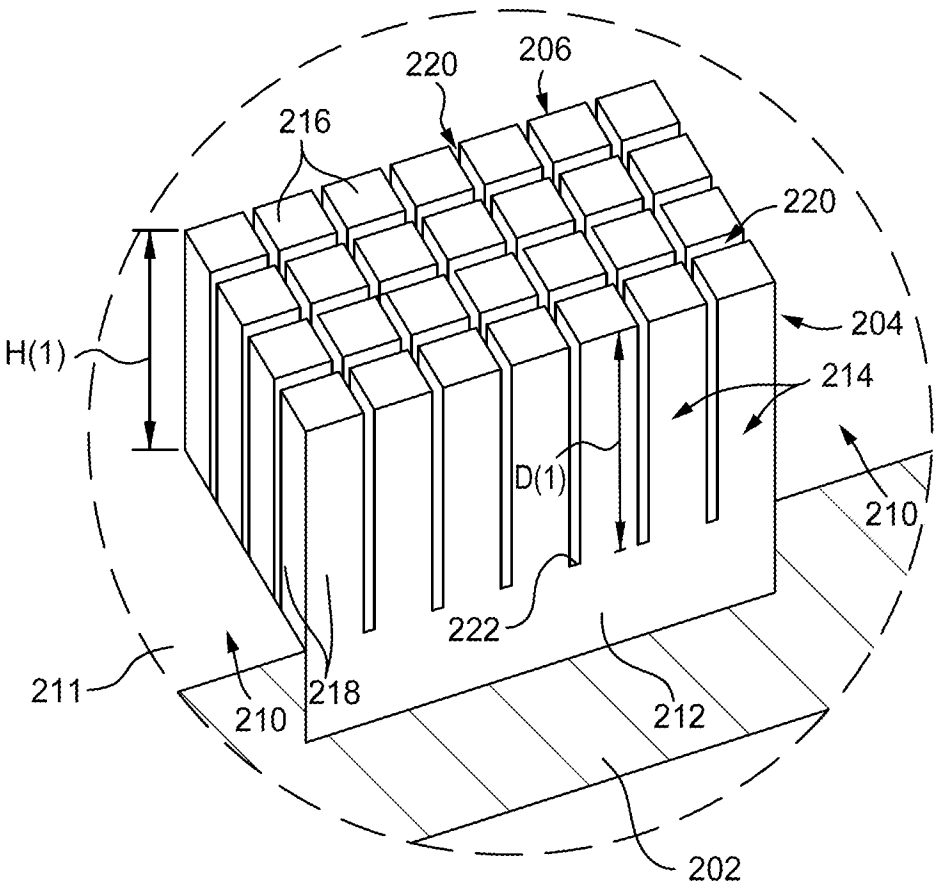
FIG. 2B is a close-up view of a portion of FIG. 2A according to embodiments described herein.

FIG. 2B is a close-up view of a portion of FIG. 2A according to embodiments described herein. Referring to FIG. 2B, each polishing element 204 includes a plurality of individual posts 214. Each post 214 includes an individual surface 216 that forms a portion of the polishing surface 206. The individual surface 216 of each post 214 is rectangular (square as shown) when viewed from top-down. In some other examples, the surface 216 may be curved (e.g., round or oval) or polygonal, among other shapes. Each post 214 includes one or more sidewalls 218 extending downwardly from the individual surface 216 to define a plurality of pores 220 (also referred to as "pore-features") disposed between the posts 214.

The term "pore-feature," as used herein includes openings defined in the polishing surface, voids that are formed in the polishing material below the polishing surface, pore-forming features disposed in the polishing surface, pore-forming features disposed in polishing material below the polishing surface, and combinations thereof. Pore-forming features may include a sacrificial material composition (e.g., water soluble) that dissolves upon exposure to a polishing fluid thereby forming corresponding openings in the polishing surface and/or voids in the polishing material below the polishing surface. As shown, the pores 220 are open, which may be the result of dissolution of pore-forming features from within the pores 220, or through fabrication of the polishing pad 200 without the use of pore-forming features.

As shown, the pores 220 extend downwardly or inwardly of the polishing surface 206 by a depth D(1) from the X-Y plane of the polishing surface 206 to an upward facing surface 222 of a portion of the polishing element 204 between the posts 214. As shown, the depth D(1) is about equal to the height H(1) of the polishing elements 204, and thus about equal to the depth of the grooves 210. In some other embodiments, the depth D(1) is less than the height H(1) of the polishing elements 204, and thus less than the depth of the grooves 210. In some embodiments, the depth D(1) is about 20 μm or more, such as about 40 μm or more, about 60 μm or more, about 80 μm or more, or about 100 μm or more, or within a range of about 20 μm to about 200 μm, such as about 40 μm to about 200 μm, about 40 μm to about 100 μm, or about 100 μm to about 200 μm.

As shown, the pores 220 are interconnected. The term "interconnected" as used herein refers to pores 220 which are in fluid communication with the grooves 210 through a path which is below the X-Y plane of the polishing surface 206. In other words, the term "interconnected" refers to pores 220 which enable slurry transport in the X- or Y-direction directly to or from a corresponding groove 210 or an adjacent pore 220. In contrast, isolated pores do not enable slurry transport directly from a corresponding groove or an adjacent pore. Instead, isolated pores only enable slurry transport directly from the polishing surface. The pores 220 may also be referred to as "linear pores" due to the pores having a length measured in the X- or Y-direction much greater (e.g., by an order of magnitude or more) than a width of the pores measured between adjacent posts 214. In contrast, isolated pores have a length and width measured in the X- and Y-directions which are about the same.

FIG. 2C is a close-up, top-down view of a portion of the polishing pad 200 of FIG. 2A according to embodiments described herein. Referring to FIG. 2C, individual ones of the plurality of posts 214 are spaced apart from one another in the X-Y plane by a width W(3) of the individual pores 220 defined therebetween. The width W(3) of the individual pores 220 is less than the width W(2) of the individual grooves 210 (shown in FIG. 2A). In some embodiments, the width W(3) of the individual pores 220 is about 120 μm or less, such as about 100 μm or less, about 80 μm or less, about 60 μm or less, or about 40 μm or less, or within a range of about 40 μm to about 120 μm, such as about 40 μm to about 80 μm, about 80 μm to about 120 μm, or about 60 μm to about 100 μm. The posts 214 are sized and arranged in the X-Y plane to have a pitch P(1) measured from a sidewall 218*a* of a first post 214*a* to a same direction facing sidewall 218*b* of an adjacent second post 214*b*. In some embodiments, the pitch P(1) is about 800 μm or less, such as about 600 μm or less, or about 500 μm or less, or within a range of about 400 μm to about 800 μm, such as about 400 μm to about 600 μm, or about 400 μm to about 500 μm. In some embodiments, a ratio of the pitch P(1) to the width W(3) is within a range of about 3:1 to about 10:1, such as about 4:1 to about 8:1.

FIGS. 3A-3E illustrate exemplary interconnected pore networks viewed from top-down according to embodiments described herein. In FIGS. 3A-3E, a single polishing element 304 (304*a-e*) is shown. Each polishing element 304*a-e* is spaced apart from adjacent polishing elements (not shown) by a plurality of corresponding grooves 310 (310*a-e*). The width of the pores 320*a-e* is uniform throughout each respective polishing element 304*a-e*. However, in some other examples, the width may vary within an individual polishing element or between polishing elements. Although the pores 320*a-d* illustrated in FIGS. 3A-3D are oriented in lines which are either parallel or perpendicular to the corresponding grooves 310*a-d* (i.e., either in the X- or Y-direction), in some other examples, the pores may be arranged diagonally (e.g., pores 320*e* shown in FIG. 3E) or on a curve (e.g., in a spiral), among other arrangements.

In FIG. 3A, the posts (314*a* and 314*a*') are arranged in repeating pyramid patterned sub-units (denoted by the solid line) which radiate from a geometric center in each of the +X, −X, +Y, and −Y directions (i.e., each pyramid is rotated 90 degrees relative to each adjacent pyramid). Each post has a rectangular shape when viewed from top-down, although other polygonal and rounded shapes are contemplated. While posts 314*a* and 314*a*' have the same shape, the posts 314*a* and 314*a*' are oriented perpendicular to each other. Posts 314*a* are oriented with a long axis in the X-direction, whereas posts 314*a*' are oriented with a long axis in the Y-direction.

In FIG. 3B, the posts (314*b* and 314*b*') are arranged in repeating brick-lay patterned sub-units (denoted by the solid line). This pattern may also be referred to as a "running bond." In FIG. 3B, each column is offset, in the Y-direction, from each adjacent column by a distance equal to half a width of each post 314*b*, measured in the Y-direction, plus half a width of the adjacent pore 320*b*, measured in the Y-direction. In other words, a centerline of each pore 320*b* is aligned with a centerline of an adjacent post 314*b*. Posts 314*b* have a square shape when viewed from top-down, although other polygonal and rounded shapes are contemplated. Due to the columns being offset, posts 314*b*' which are located at the ends (in the Y-direction) of some columns are only a portion of the size of the posts 314*b* (e.g., having a rectangular shape as shown).

In FIG. 3C, the posts (314*c* and 314*c*') are arranged in repeating pinwheel patterned sub-units (denoted by the solid line). Each sub-unit includes an outer wheel of posts 314*c*. Each post 314*c* is rotated by 90° relative to each adjacent post 314*c* in the wheel. The posts 314*c* forming the outer wheel surround a center post 314*c*'. In the illustrated example, posts 314*c* have a rectangular shape when viewed from top-down, and posts 314*c*' have a square shape when viewed from top-down, although other polygonal and rounded shapes are contemplated.

In FIG. 3D, the posts (314*d* and 314*d*') are arranged in repeating basket weave patterned sub-units (denoted by the solid line). Each sub-unit includes a 2×2 grid with each individual unit in the 2×2 grid including a pair of parallel rectangular posts. Each pair of posts 314*d* is rotated by 90° relative to each adjacent pair of posts 314*d*' in the same sub-unit. In the illustrated example, posts 314*d* and 314*d*' have a rectangular shape when viewed from top-down, although other polygonal and rounded shapes are contemplated.

In FIG. 3E, the posts (314*e* and 314*e*') are arranged in repeating herringbone patterned sub-units (denoted by the solid line). The posts are arranged in a zig-zag pattern such that each post 314*e* is perpendicular to each adjacent post 314*e*' in the same zig-zag. In the illustrated example, posts 314*e* and 314*e*' have a rectangular shape when viewed from top-down, although other polygonal and rounded shapes are contemplated.

Flow of slurry through the interconnected pore networks shown in FIGS. 3A-3E may be modulated based on pore depth, pore width, pore topography, surface roughness, pore tortuosity, and pore network geometry, among other factors. Overall flow resistance across the polishing pad is dependent on a combination of flow resistance through the pores and flow resistance through the grooves. In general, flow resistance is about the same or lower through the grooves compared to the pores. In some embodiments, in order to facilitate uniform flow across the polishing pad, it may be desirable that total flow resistance through the grooves matches total flow resistance through the pores. In some embodiments, a ratio of the total flow resistance through the grooves to the total flow resistance through the pores is within a range of about 1:4 to about 1:1, such as about 1:2 to about 1:1, about 1:1.5 to about 1:1, or about 1:1.1 to about 1:1.

An important aspect of pore network geometry as it relates to flow resistance is directionality or degree of interconnectedness of the pore network. In FIGS. 3A-3E, some linear pores extend completely across the polishing element and connect to grooves on opposite sides of the polishing element. These may be referred to as "primary pores" and are denoted by the dashed lines. Some other linear pores connect to only one groove and extend only partially across the polishing element. Some diagonal pores connect to two different grooves but extend only partially across the polishing element. These may be referred to as "secondary pores." Some other linear pores intersect only primary or secondary pores and do not connect to any grooves. These may be referred to as "tertiary pores." The frequency and arrangement of primary, secondary, and tertiary pores affects the directionality and interconnectedness of each pore network, and thus the flow resistance thereof. The number of primary, secondary, and tertiary pores for FIGS. 3A-3E are listed in Table 2. The number of connections between two or more pores, which is a simple measure of interconnectedness, is also listed in Table 2.

TABLE 2

| FIG. | Primary Pores | Secondary Pores | Tertiary Pores | Pore Connections |
|---|---|---|---|---|
| 3A | 2 | 10 | 19 | 48 |
| 3B | 6 | 12 | 33 | 78 |
| 3C | 2 | 8 | 8 | 25 |
| 3D | 14 | 16 | 48 | 154 |
| 3E | 0 | 45 | 36 | 105 |

In terms of directionality, each of the primary pores in FIGS. 3A-3B is in the Y-direction, whereas in FIGS. 3C-3D at least one primary pore is oriented in each of the X- and Y-directions. Thus, the pore networks shown in FIGS. 3A-3B may be referred to as unidirectional, or non-symmetric, whereas the pore network shown in FIGS. 3C-3D may be referred to as bi-directional, or symmetric. FIG. 3E is another example of a bi-directional network. In general, the number of pore connections is proportional to the number of tertiary pores in each network. In this example, the pore network shown in FIG. 3D may be referred to as highly interconnected, the pore networks shown in FIGS. 3A and 3C may be referred to as only slightly interconnected, and the pore networks shown in FIGS. 3B and 3E may be referred to as moderately interconnected.

FIGS. 4A-4F are schematic plan views of polishing pads 400*a*-400*f* having polishing elements 404*a-f* with various shapes which may be used with or in place of the polishing elements 204 of the polishing pad 200 described in FIG. 2A. Each of the polishing pads 400*a*-400*f* in FIGS. 4A-4F includes a pixel chart having white regions (regions in white pixels) that represent the polishing elements 404*a-f* and black regions (regions in black pixels) that represent the foundation layer 402.

Figure 4A:
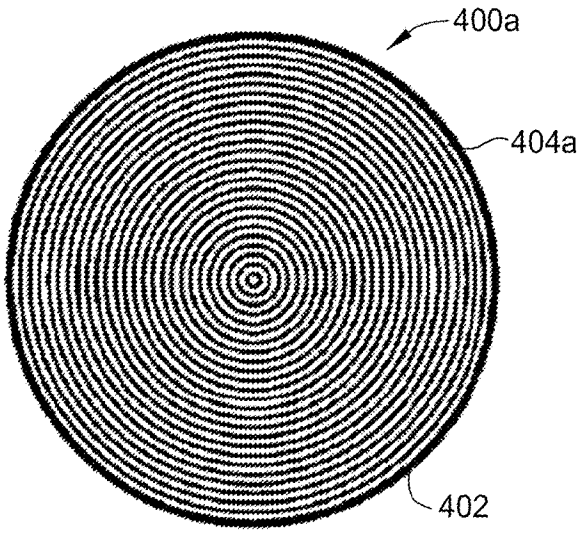
FIGS. 4A-4F are schematic plan views of various polishing pad designs which may be used in place of the pad design shown in FIG. 2A according to embodiments described herein.
Figure 4B:
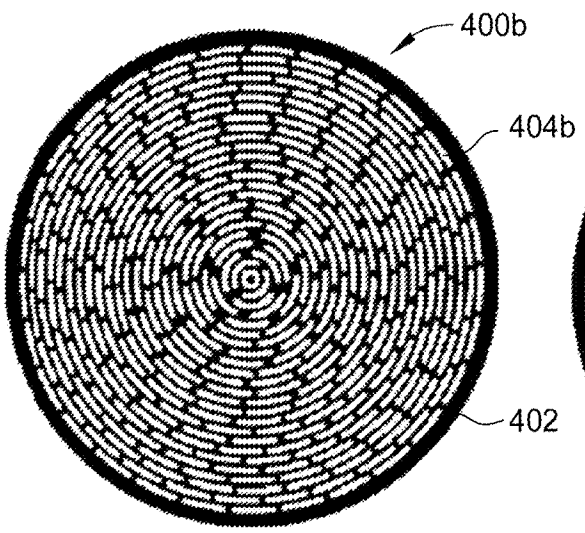
Figure 4C:
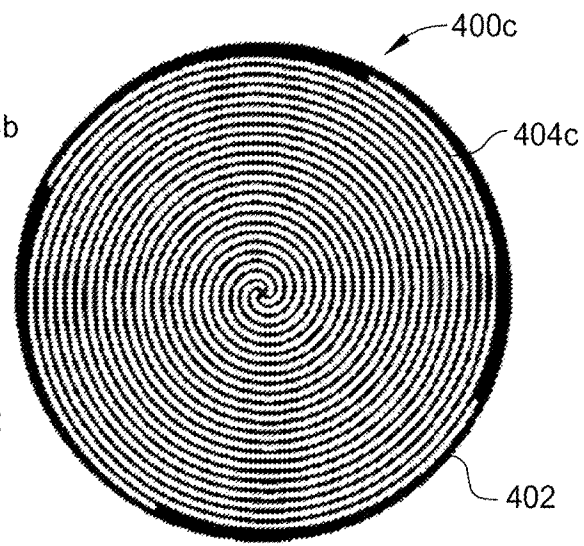
Figure 4D:
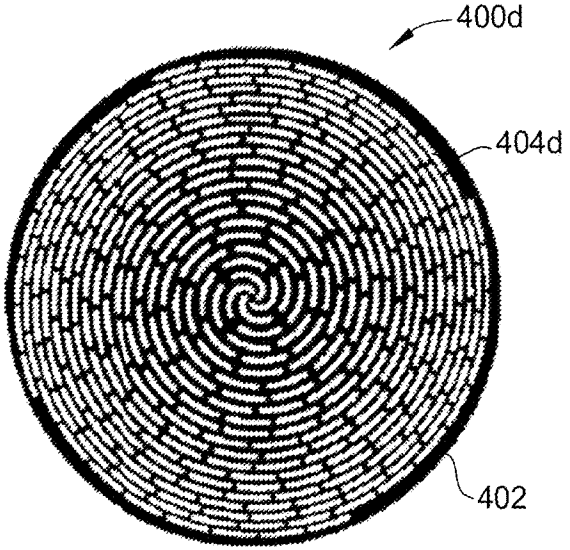

In FIG. 4A, the polishing elements 404*a* include a plurality of concentric annular rings. In FIG. 4B, the polishing elements 404*b* include a plurality of segments of concentric annular rings. In FIG. 4C, the polishing elements 404*c* form a plurality of spirals (four shown) extending from a center of the polishing pad 400*c* to an edge of the polishing pad 400*c* or proximate thereto. In FIG. 4D, a plurality of discontinuous polishing elements 404*d* are arranged in a spiral pattern on the foundation layer 402.

Figure 4E:
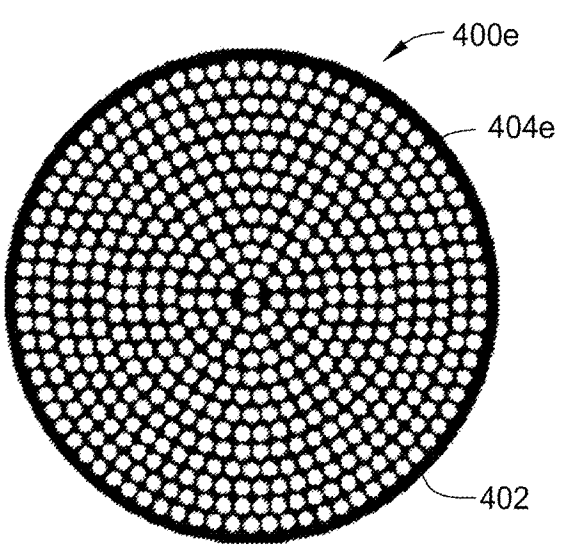
Figure 4F:
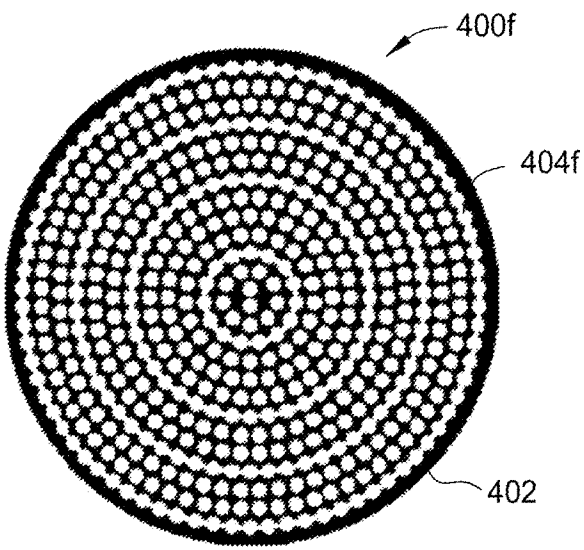

In FIG. 4E, each of the plurality of polishing elements 404*e* includes a cylindrical post extending upwardly from the foundation layer 402. In other embodiments, the polishing elements 404*e* are of any suitable cross-sectional shape, for example columns with toroidal, partial toroidal (e.g., arc), oval, square, rectangular, triangular, polygonal, irregular shapes in a section cut generally parallel to the underside surface of the pad 400*e*, or combinations thereof. FIG. 4F illustrates the polishing pad 400*f* having a plurality of discrete polishing elements 404*f* extending upwardly from the foundation layer 402. The polishing pad 400*f* of FIG. 4F is similar to the polishing pad 400*e* except that some of the polishing elements 404*f* are connected to form one or more closed circles. The one or more closed circles create damns to retain polishing fluid during a CMP process.

FIGS. 5A-5D illustrate top-down views of exemplary polishing elements with either isolated pores 520*a* or interconnected pores 520*b-d* having pore architectures according to the parameters listed in Table 3. In FIGS. 5A-5D, a single polishing element 504 (504*a-d*) is shown. Each polishing element 504*a-d* is spaced apart from adjacent polishing elements (not shown) by a plurality of corresponding grooves 510 (510*a-d*). The pore density of each polishing element 504*a-d* is approximately 25%. The depth of each pore is approximately 100 μm. Based on the above listed parameters, the time-based evolution of average new slurry volume fraction across a single polishing element in one principal direction was simulated using computational fluid dynamics (CFD) modeling. The results are shown graphically on the right side of each figure. The solid lines indicate the average new slurry volume fraction at the polishing surface (e.g., polishing surface 206 of FIG. 2A). It is noted that flow resistance due to surface roughness at the polishing surface is not included in the simulation. The dashed lines indicate the average new slurry volume fraction within the pores (e.g., at a depth of 50 μm below the plane of the polishing surface, or about half the total depth of the pores).

TABLE 3

| FIG. | Pore Width (μm) | Pore Pitch (μm) | Groove Width (mm) |
|---|---|---|---|
| 5A | 80 | 80 | 340 |
| 5B | 80 | 480 | 340 |
| 5C | 80 | 480 | 680 |
| 5D | 160 | 800 | 340 |

As shown FIG. 5A (isolated pores 520*a*), an initial rate of slurry evolution (measured in terms of average new slurry volume fraction as a function of time) at the polishing surface corresponds to the average slope of the solid line in the region labeled 501*a*. Likewise, an initial rate of slurry evolution within the pores corresponds to the average slope of the dashed line in the region labeled 503*a*. Thus, the term "initial rate" as used herein may refer to an average slope in a graph of average new slurry volume fraction as a function of time within a time range before the average new slurry volume fraction begins to plateau. As shown, the initial rate of slurry evolution within the pores is reduced by about 30% compared to the initial rate of slurry evolution at the polishing surface. In contrast, as shown in FIG. 5B (interconnected pores 520*b*), the initial rate of slurry evolution within the pores is about equal to the initial rate of slurry evolution at the polishing surface. As shown in FIG. 5B, the average new slurry volume fraction within the interconnected pores 520*b* reaches as high as 90% or more (e.g., about 95%) at the initial rate, whereas the average new slurry volume fraction within the isolated pores (FIG. 5A) only reaches between about 60% and about 70% (e.g., about 65%) at the initial rate. Thus, the interconnected pores result in faster and more uniform slurry transport compared to the isolated pores.

As shown in FIG. 5B, the average new slurry volume fraction within the interconnected pores reaches about 100% during the time period shown, whereas the average new slurry volume fraction within the isolated pores only reaches between about 75% and about 80% over the same time period. Thus, the interconnected pores result in more complete replacement of old slurry with new slurry (referred to as "turnover") over short time scales (e.g., less than about 0.5 second).

As shown in FIG. 5C (which has 2× groove width compared to FIG. 5B), the initial rate of slurry evolution is about the same as FIG. 5B both at the polishing surface and within the pores. However, in FIG. 5B the average new slurry volume fraction within the interconnected pores 520*b* reaches as high as 90% or more (e.g., about 95%) at the initial rate, whereas the average new slurry volume fraction within the interconnected pores 520*c* only reaches about 70% at the initial rate. Thus, the reduced width of groove 510*b* in FIG. 5B results in faster slurry transport compared to the 2× groove width of groove 510*c* in FIG. 5C. This difference may result from a decreased resistance to flow through the groove 510*c* compared to the groove 510*b* which reduces a total volume of slurry transported through the pores 520*c*. Even though slurry transport is reduced from FIG. 5B to FIG. 5C, the interconnected pores 520*c* still result in faster and more uniform slurry transport compared to the isolated pores.

As shown in FIG. 5D (which has greater pore width and greater pore pitch compared to FIG. 5B), the initial rate of slurry evolution is similar to the results for the isolated pores 510*a* of FIG. 5A. Thus, the greater width and pitch of the interconnected pores 510*d* shown in FIG. 5D results in slower and less uniform slurry transport compared to the interconnected pores 510*b-c* shown in FIGS. 5B-5C. This difference may result from reduced intermixing of the slurry within the pores 510*d* which may remove much of the effectiveness of the interconnected pore architecture as described above.

Figure 5E:
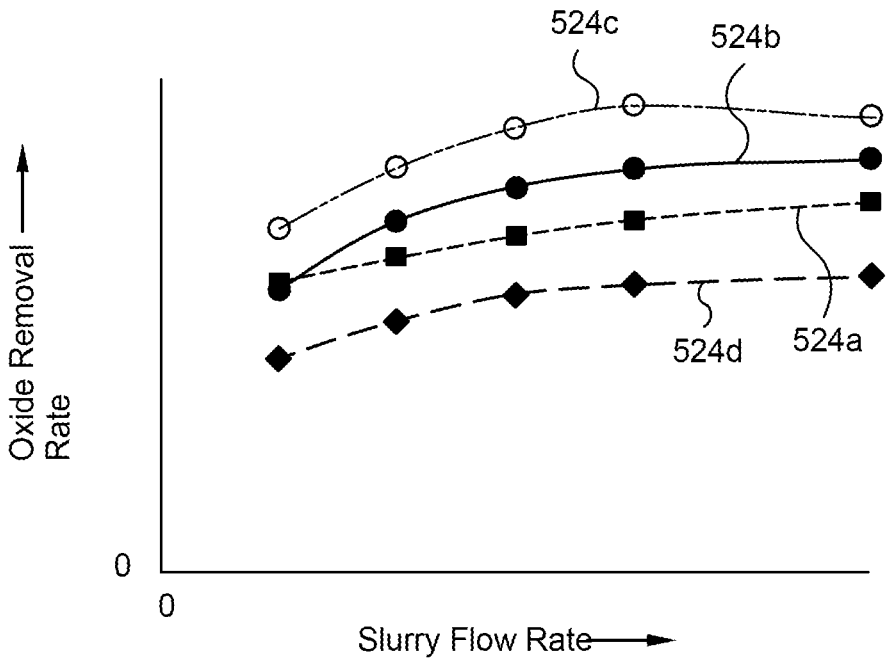
FIG. 5E illustrates oxide removal rates measured at various slurry flow rates for each polishing element shown in FIGS. 5A-5D.

Experimental data supports the CFD modeling results described above. In FIG. 5E, oxide removal rates measured at various slurry flow rates are illustrated for each polishing element 504*a-d* shown in FIGS. 5A-5D. Data sets 524*a-d* correspond to polishing elements 504*a-d*, respectively. In particular, due to improvements in slurry transport with interconnected pores (e.g., faster slurry transport, more uniform slurry transport, and/or more complete turnover of slurry), oxide removal rates are greater (at least above some minimum level of slurry flow rate) using polishing elements 504*b-c* compared to polishing element 504*a* with isolated pores. In one example, the oxide removal rate is increased by about 25% or more. In another example, the oxide removal rate is increased by about 50% or more.

Figure 5F:
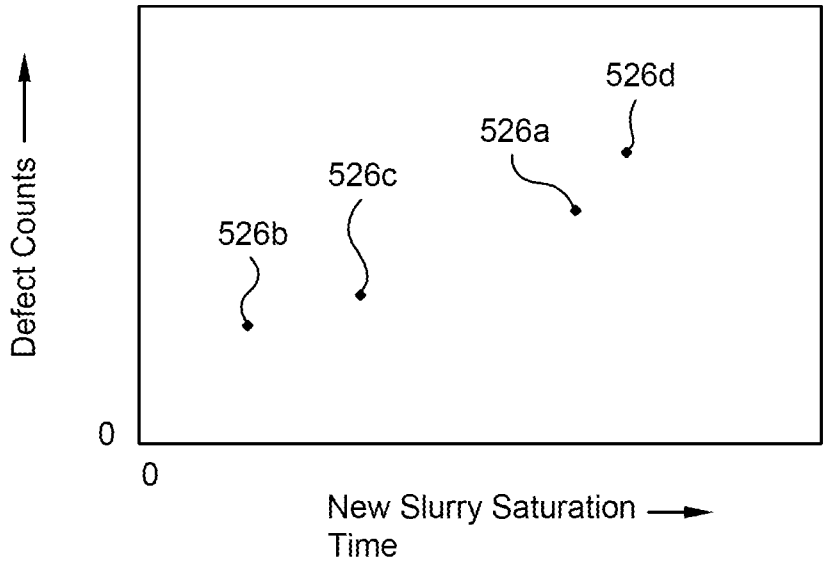
FIG. 5F illustrates defect counts relative to corresponding new slurry saturation times for each polishing element shown in FIGS. 5A-5D.

In FIG. 5F, defect counts for each polishing element 504*a-d* shown in FIGS. 5A-5D are illustrated relative to corresponding new slurry saturation times. Data points 526*a-d* correspond to polishing elements 504*a-d*, respectively. In particular, due to improvements in slurry transport with interconnected pores (e.g., faster slurry transport, more uniform slurry transport, and/or more complete turnover of slurry), defect counts are lower using polishing elements 504*b-c* compared to polishing element 504*a* with isolated pores. In one example, the defect counts are reduced by about 40% or more. In another example, the defect counts are reduced by about 50% or more.

Additive Manufacturing System and Process Examples

Figure 6A:
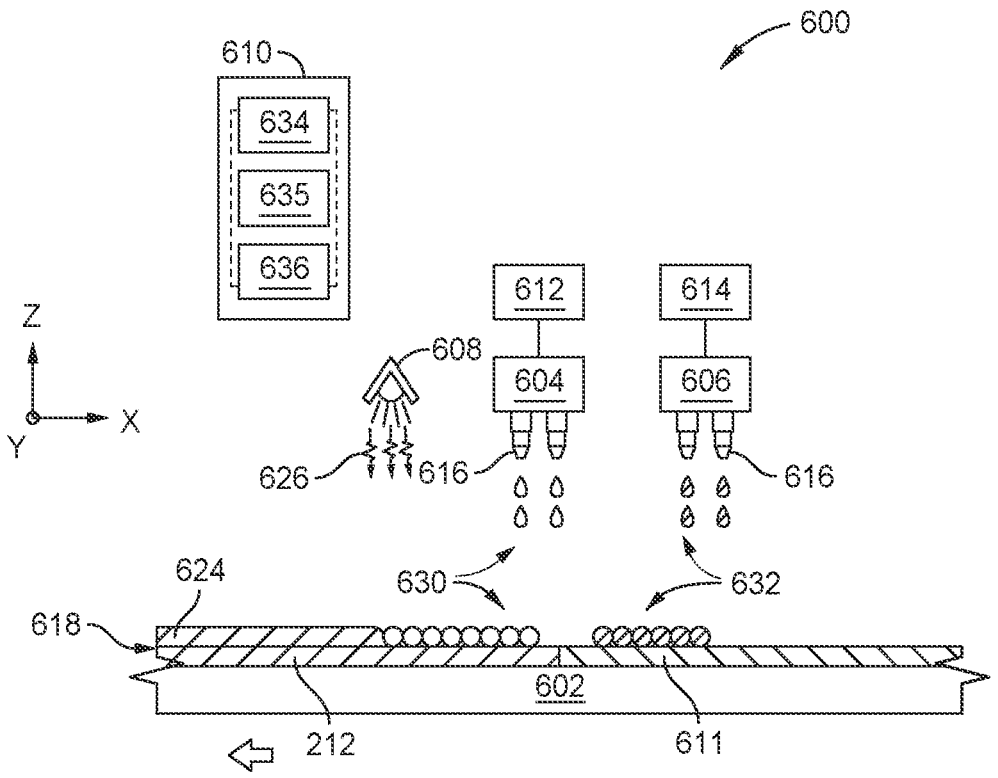
FIG. 6A is a schematic sectional view of an additive manufacturing system, which may be used to form the polishing pads described herein.

FIG. 6A is a schematic sectional view of an additive manufacturing system, which may be used to form the polishing pads described herein, according to some embodiments. Here, the additive manufacturing system 600 features a movable manufacturing support 602, a plurality of dispense heads 604 and 606 disposed above the manufacturing support 602, a curing source 608, and a system controller 610. In some embodiments, the dispense heads 604, 606 move independently of one another and independently of the manufacturing support 602 during the polishing pad manufacturing process. Here, the first and second dispense heads 604 and 606 are respectively fluidly coupled to a first pre-polymer composition source 612 and an optional sacrificial material source 614 which are used to form the polymer material 212 and pore-features 610, respectively, as described above. The additive manufacturing system 600 may feature at least one more dispense head (e.g., a third dispense head, not shown) which is fluidly coupled to a second pre-polymer composition source used to form the foundation layer 202 described above. In some embodiments, the additive manufacturing system 600 includes as many dispense heads as desired to each dispense a different pre-polymer composition or sacrificial material composition. In some embodiments, the additive manufacturing system 600 further includes pluralities of dispense heads where two or more dispense heads are configured to dispense the same pre-polymer compositions or sacrificial material compositions.

Here, each of the dispense heads 604, 606 features an array of droplet ejecting nozzles 616 configured to eject droplets 630, 632 of the respective pre-polymer composition 612 and sacrificial material composition 614 delivered to the dispense head reservoirs. Here, the droplets 630, 632 are ejected towards the manufacturing support and thus onto the manufacturing support 602 or onto a previously formed print layer 618 disposed on the manufacturing support 602. Each of dispense heads 604, 606 may be configured to fire (control the ejection of) droplets 630, 632 from each of the nozzles 616 in a respective geometric array or pattern independently of the firing of other nozzles 616 thereof. Herein, the nozzles 616 are independently fired according to a droplet dispense pattern for a print layer to be formed, such as the print layer 624, as the dispense heads 604, 606 move relative to the manufacturing support 602. Once dispensed, the droplets 630 of the pre-polymer composition 612 and/or the droplets 632 of the sacrificial material composition 614 are at least partially cured by exposure to electromagnetic radiation, e.g., UV radiation 626, provided by the curing source 608, e.g., an electromagnetic radiation source, such as a UV radiation source to form a print layer, such as the partially formed print layer 624.

Figure 6B:
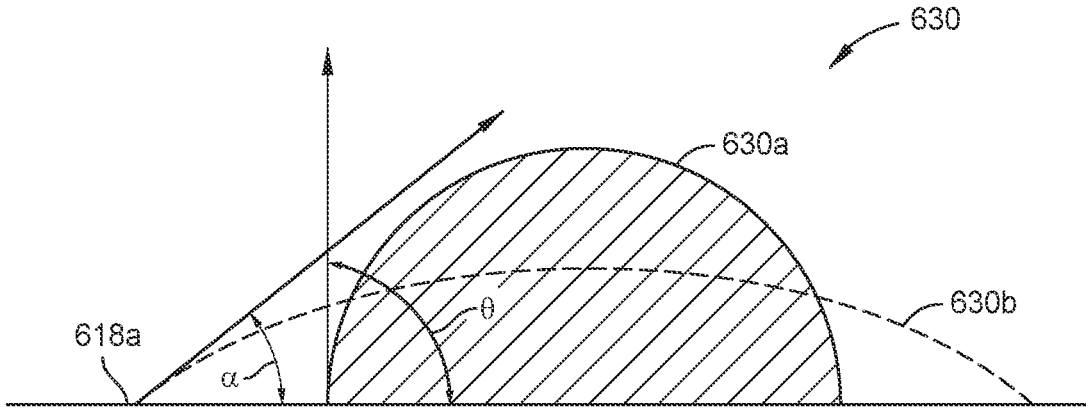
FIG. 6B is a close-up cross-sectional view schematically illustrating a droplet disposed on a surface of a previously formed print layer according to embodiments described herein.

In some embodiments, dispensed droplets of the pre-polymer compositions, such as the dispensed droplets 630 of the pre-polymer composition 612, are exposed to electromagnetic radiation to physically fix the droplet before it spreads to an equilibrium size such as set forth in the description of FIG. 6B. Typically, the dispensed droplets are exposed to electromagnetic radiation to at least partially cure the pre-polymer compositions thereof within 1 second or less of the droplet contacting a surface, such as the surface of the manufacturing support 602 or of a previously formed print layer 618 disposed on the manufacturing support 602.

FIG. 6B is a close up cross-sectional view schematically illustrating a droplet 630 disposed on a surface 618*a* of a previously formed layer, such as the previously formed layer 618 described in FIG. 6A, according to some embodiments. In a typically additive manufacturing process, a droplet of pre-polymer composition, such as the droplet 630*a* spreads and reaches an equilibrium contact angle $\alpha$ with the surface 618*a* of a previously formed layer within about one second from the moment in time that the droplet 630*a* contacts the surface 618*a*. The equilibrium contact angle $\alpha$ is a function of at least the material properties of the pre-polymer composition and the energy at the surface 618*a* (surface energy) of the previously formed layer, e.g., previously formed layer 618. In some embodiments, it is desirable to at least partially cure the dispensed droplet before it reaches an equilibrium size in order to fix the droplets contact angle with the surface 618*a* of the previously formed layer. In those embodiments, the fixed droplet's 630*b* contact angle $\theta$ is greater than the equilibrium contact angle $\alpha$ of the droplet 630*a* of the same pre-polymer composition which was allowed to spread to its equilibrium size.

Herein, at least partially curing a dispensed droplet causes the at least partial polymerization, e.g., the cross-linking, of the pre-polymer composition(s) within the droplets and with adjacently disposed droplets of the same or different pre-polymer composition to form a continuous polymer phase. In some embodiments, the pre-polymer compositions are dispensed and at least partially cured to form a well about a desired pore before a sacrificial material composition is dispensed thereinto.

As described above, the deposition of a sacrificial material is used to form pore-forming features in the polishing pad. However, in some other examples, polishing pads described herein may be fabricated without the use of pore-forming features. In such examples, the optional sacrificial material source 614 may be omitted, and the pores may be formed as void spaces within a continuous polymer phase of polymer material 212.

Formulation and Material Examples

The pre-polymer compositions used to form the foundation layer 202 and the polymer material 212 of the polishing elements described above each includes a mixture of one or more of functional polymers, functional oligomers, functional monomers, reactive diluents, and photoinitiators.

Examples of suitable functional polymers which may be used to form one or both of the at least two pre-polymer compositions include multifunctional acrylates including di, tri, tetra, and higher functionality acrylates, such as 1,3,5-triacryloylhexahydro-1,3,5-triazine or trimethylolpropane triacrylate.

Examples of suitable functional oligomers which may be used to form one or both of the at least two pre-polymer compositions include monofunctional and multifunctional oligomers, acrylate oligomers, such as aliphatic urethane acrylate oligomers, aliphatic hexafunctional urethane acrylate oligomers, diacrylate, aliphatic hexafunctional acrylate oligomers, multifunctional urethane acrylate oligomers, aliphatic urethane diacrylate oligomers, aliphatic urethane acrylate oligomers, aliphatic polyester urethane diacrylate blends with aliphatic diacrylate oligomers, or combinations thereof, for example bisphenol-A ethoxylate diacrylate or polybutadiene diacrylate, tetrafunctional acrylated polyester oligomers, aliphatic polyester based urethane diacrylate oligomers and aliphatic polyester based acrylates and diacrylates.

Examples of suitable monomers which may be used to form one or both of the at least two pre-polymer compositions include both mono-functional monomers and multi-functional monomers. Suitable mono-functional monomers include tetrahydrofurfuryl acrylate (e.g. SR285 from Sartomer®), tetrahydrofurfuryl methacrylate, vinyl caprolactam, isobornyl acrylate, isobornyl methacrylate, 2-phenoxyethyl acrylate, 2-phenoxyethyl methacrylate, 2-(2-ethoxyethoxy)ethyl acrylate, isooctyl acrylate, isodecyl acrylate, isodecyl methacrylate, lauryl acrylate, lauryl methacrylate, stearyl acrylate, stearyl methacrylate, cyclic trimethylolpropane formal acrylate, 2-[[(Butylamino) carbonyl] oxy]ethyl acrylate (e.g. Genomer 1122 from RAHN USA Corporation), 3,3,5-trimethylcyclohexane acrylate, or mono-functional methoxylated PEG (350) acrylate. Suitable multifunctional monomers include diacrylates or dimethacrylates of diols and polyether diols, such as propoxylated neopentyl glycol diacrylate, 1,6-hexanediol diacrylate, 1,6-hexanediol dimethacrylate, 1,3-butylene glycol diacrylate, 1,3-butylene glycol dimethacrylate 1,4-butanediol diacrylate, 1,4-butanediol dimethacrylate, alkoxylated aliphatic diacrylate (e.g., SR9209A from Sartomer®), diethylene glycol diacrylate, diethylene glycol dimethacrylate, dipropylene glycol diacrylate, tripropylene glycol diacrylate, triethylene glycol dimethacrylate, alkoxylated hexanediol diacrylates, or combinations thereof, for example SR562, SR563, SR564 from Sartomer®.

Typically, the reactive diluents used to form one or more of the pre-polymer compositions are least monofunctional, and undergo polymerization when exposed to free radicals, Lewis acids, and/or electromagnetic radiation. Examples of suitable reactive diluents include monoacrylate, 2-ethylhexyl acrylate, octyldecyl acrylate, cyclic trimethylolpropane formal acrylate, caprolactone acrylate, isobornyl acrylate (IBOA), or alkoxylated lauryl methacrylate.

Examples of suitable photoinitiators used to form one or more of the at least two different pre-polymer compositions include polymeric photoinitiators and/or oligomer photoinitiators, such as benzoin ethers, benzyl ketals, acetyl phenones, alkyl phenones, phosphine oxides, benzophenone compounds and thioxanthone compounds that include an amine synergist, or combinations thereof.

Examples of polishing pad materials formed of the pre-polymer compositions described above typically include at least one of oligomeric and, or, polymeric segments, compounds, or materials selected from the group consisting of: polyamides, polycarbonates, polyesters, polyether ketones, polyethers, polyoxymethylenes, polyether sulfone, polyetherim ides, polyim ides, polyolefins, polysiloxanes, polysulfones, polyphenylenes, polyphenylene sulfides, polyurethanes, polystyrene, polyacrylonitriles, polyacrylates, polymethylmethacrylates, polyurethane acrylates, polyester acrylates, polyether acrylates, epoxy acrylates, polycarbonates, polyesters, melamines, polysulfones, polyvinyl materials, acrylonitrile butadiene styrene (ABS), halogenated polymers, block copolymers, and random copolymers thereof, and combinations thereof.

The sacrificial material composition(s), which may be used to form the pore-features described above, include water-soluble material, such as, glycols (e.g., polyethylene glycols), glycol-ethers, and amines. Examples of suitable sacrificial material precursors which may be used to form the pore forming features described herein include ethylene glycol, butanediol, dimer diol, propylene glycol-(1,2) and propylene glycol-(1,3), octane-1,8-diol, neopentyl glycol, cyclohexane dimethanol (1,4-bis-hydroxymethylcyclohexane), 2-methyl-1,3-propane diol, glycerine, trimethylolpropane, hexanediol-(1,6), hexanetriol-(1,2,6) butane triol-(1,2,4), trimethylolethane, pentaerythritol, quinitol, mannitol and sorbitol, methylglycoside, also diethylene glycol, triethylene glycol, tetraethylene glycol, polyethylene glycols, dibutylene glycol, polybutylene glycols, ethylene glycol, ethylene glycol monobutyl ether (EGMBE), diethylene glycol monoethyl ether, ethanolamine, diethanolamine (DEA), triethanolamine (TEA), and combinations thereof.

In some embodiments, the sacrificial material precursor includes a water soluble polymer, such as 1-vinyl-2-pyrrolidone, vinylimidazole, polyethylene glycol diacrylate, acrylic acid, sodium styrenesulfonate, Hitenol BC10®, Maxemul 6106®, hydroxyethyl acrylate and [2-(methacryloyloxy)ethyltrimethylammonium chloride, 3-allyloxy-2-hydroxy-1-propanesulfonic acid sodium, sodium 4-vinylbenzenesulfonate, [2-(methacryloyloxy)ethyl]dimethyl-(3-sulfopropyl)ammonium hydroxide, 2-acrylamido-2-methyl-1-propanesulfonic acid, vinylphosphonic acid, allyltriphenylphosphonium chloride, (vinylbenzyl)trimethylammonium chloride, allyltriphenylphosphonium chloride, (vinylbenzyl)trimethylammonium chloride, E-SPERSE RS-1618, E-SPERSE RS-1596, methoxy polyethylene glycol monoacrylate, methoxy polyethylene glycol diacrylate, methoxy polyethylene glycol triacrylate, or combinations thereof.

Here, the additive manufacturing system 600 shown in FIG. 6A further includes the system controller 610 to direct the operation thereof. The system controller 610 includes a programmable central processing unit (CPU) 634 which is operable with a memory 635 (e.g., non-volatile memory) and support circuits 636. The support circuits 636 are conventionally coupled to the CPU 634 and include cache, clock circuits, input/output subsystems, power supplies, and the like, and combinations thereof coupled to the various components of the additive manufacturing system 600, to facilitate control thereof. The CPU 634 is one of any form of general purpose computer processor used in an industrial setting, such as a programmable logic controller (PLC), for controlling various components and sub-processors of the additive manufacturing system 600. The memory 635, coupled to the CPU 634, is non-transitory and is typically one or more of readily available memories such as random access memory (RAM), read only memory (ROM), floppy disk drive, hard disk, or any other form of digital storage, local or remote.

Typically, the memory 635 is in the form of a computer-readable storage media containing instructions (e.g., non-volatile memory), which when executed by the CPU 634, facilitates the operation of the manufacturing system 600. The instructions in the memory 635 are in the form of a program product such as a program that implements the methods of the present disclosure.

The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure. In some embodiments, the methods set forth herein, or portions thereof, are performed by one or more application specific integrated circuits (ASICs), field-programmable gate arrays (FPGAs), or other types of hardware implementations. In some other embodiments, the polishing pad manufacturing methods set forth herein are performed by a combination of software routines, ASIC(s), FPGAs and, or, other types of hardware implementations.

Here, the system controller 610 directs the motion of the manufacturing support 602, the motion of the dispense heads 604 and 606, the firing of the nozzles 616 to eject droplets of pre-polymer compositions therefrom, and the degree and timing of the curing of the dispensed droplets provided by the UV radiation source 608. In some embodiments, the instructions used by the system controller to direct the operation of the manufacturing system 600 include droplet dispense patterns for each of the print layers to be formed. In some embodiments, the droplet dispense patterns are collectively stored in the memory 635 as CAD-compatible digital printing instructions.

Figure 7:
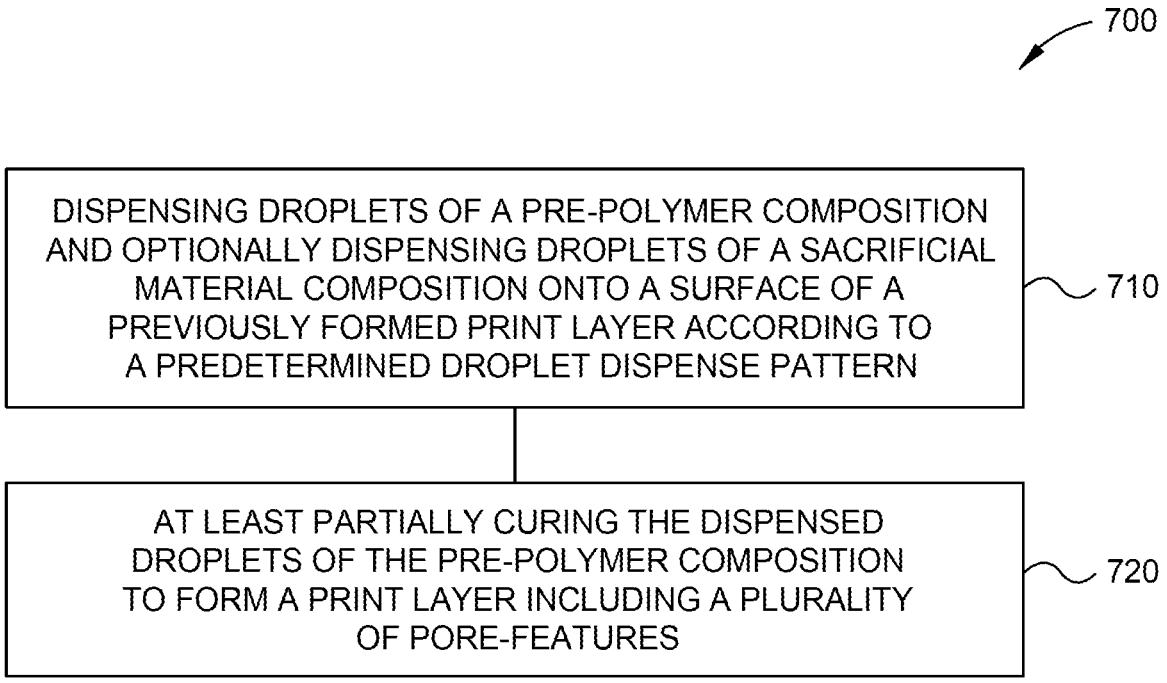
FIG. 7 is a flow diagram setting forth a method of forming a polishing pad according to embodiments described herein.

FIG. 7 is a flow diagram setting forth a method of forming a print layer of a polishing pad according to embodiments described herein. Embodiments of the method 700 may be used in combination with one or more of the systems and system operations described herein, such as the additive manufacturing system 600 of FIG. 6A and the fixed droplets of FIG. 6B. Further, embodiments of the method 700 may be used to form any one or combination of embodiments of the polishing pads shown and described herein.

At activity 710, the method 700 includes dispensing droplets of a pre-polymer composition and optionally dispensing droplets of a sacrificial material composition onto a surface of a previously formed print layer according to a predetermined droplet dispense pattern.

At activity 720, the method 700 includes at least partially curing the dispensed droplets of the pre-polymer composition to form a print layer including a plurality of pore-features.

In some embodiments, the method 700 further includes sequential repetitions of activities 710 and 720 to form a plurality of print layers stacked in a Z-direction, i.e., a direction orthogonal to the surface of the manufacturing support or a previously formed print layer disposed thereon. The predetermined droplet dispense pattern used to form each print layer may be the same or different as a predetermined droplet dispense pattern used to form a previous print layer disposed there below. In some embodiments, the plurality of print layers include a polishing layer having a plurality of pores, or pore-features, formed therein. In some embodiments, the plurality of print layers include a polishing layer having a plurality of pore-forming features formed therein in which the plurality of pore-forming features include the sacrificial material composition.

While the foregoing is directed to embodiments of the present disclosure, other and further embodiments of the disclosure may be devised without departing from the basic scope thereof, and the scope thereof is determined by the claims that follow.

The invention claimed is:

1. A polishing pad, comprising:

a plurality of polishing elements, each polishing element comprising:

a plurality of individual posts, each individual post comprising:

an individual surface that forms a portion of a polishing surface of the polishing pad; and one or more sidewalls extending downwardly from the individual surface; and a plurality of grooves disposed between adjacent polishing elements of the plurality of polishing elements, wherein each polishing element of the plurality of polishing elements has a width of 5 mm or less, and the sidewalls of the plurality of individual posts define a plurality of pores between adjacent individual posts of the plurality of individual posts, each pore of the plurality of pores having a width of 120 μm or less.

2. The polishing pad of claim 1, wherein the plurality of pores are interconnected.

3. The polishing pad of claim 1, wherein at least one pore of the plurality of pores extends completely across each polishing element of the plurality of polishing elements and connects to the plurality of grooves on opposite sides of the each polishing element of the plurality of polishing elements.

4. The polishing pad of claim 1, wherein a polishing layer formed of the plurality of polishing elements extends a first height above a foundation layer of the polishing pad, and wherein a depth of each pore of the plurality of pores is about equal to the first height.

5. The polishing pad of claim 1, wherein a width of each pore of the plurality of pores is less than a width of each groove of the plurality of grooves.

6. The polishing pad of claim 1, wherein the plurality of polishing elements and the plurality of individual posts are positioned such that a ratio of total flow resistance through the plurality of grooves to total flow resistance through the plurality of pores is about 1:4 to about 1:1.

7. The polishing pad of claim 1, wherein the plurality of polishing elements and the plurality of individual posts are positioned such that a total flow resistance through the plurality of grooves is about equal to a total flow resistance through the plurality of pores.

8. The polishing pad of claim 1, wherein a depth of each pore of the plurality of pores is about equal to a depth of each groove of the plurality of grooves.

9. The polishing pad of claim 1, wherein the plurality of individual posts are arranged in repeating sub-units.

10. The polishing pad of claim 9, wherein each repeating sub-unit comprises a pyramid pattern.

11. The polishing pad of claim 9, wherein each repeating sub-unit comprises a brick-lay pattern.

12. The polishing pad of claim 9, wherein each repeating sub-unit comprises a pinwheel pattern.

13. A method of forming a polishing pad, comprising:

(a) dispensing droplets of a pre-polymer composition onto a surface of a previously formed print layer according to a predetermined droplet dispense pattern;

(b) at least partially curing the dispensed droplets of the pre-polymer composition to form a print layer; and (c) sequentially repeating (a) and (b) to form a plurality of polishing elements, wherein a plurality of grooves are disposed between adjacent polishing elements of the plurality of polishing elements, each polishing element comprising:

a plurality of individual posts, each individual post comprising:

an individual surface that forms a portion of a polishing surface of the polishing pad; and one or more sidewalls extending downwardly from the individual surface, wherein each polishing element of the plurality of polishing elements has a width of 5 mm, and the sidewalls of the plurality of individual posts define a plurality of pores between adjacent individual posts of the plurality of individual posts, and wherein the plurality of pores are interconnected, each pore of the plurality of pores having a width of 120 μm or less.

14. The method of claim 13, further comprising dispensing droplets of a sacrificial material composition onto the surface of the previously formed print layer according to the predetermined droplet dispense pattern.

15. The method of claim 13, wherein the predetermined droplet dispense pattern corresponds to an arrangement of the plurality of individual posts in repeating sub-units.

16. The method of claim 15, wherein each repeating sub-unit comprises at least one of a pyramid pattern, a brick-lay pattern, or a pinwheel pattern.

17. A method of polishing a substrate, comprising:

urging a substrate against a polishing surface of a polishing pad, the polishing pad comprising a plurality of polishing elements and a plurality of grooves disposed between adjacent polishing elements of the plurality of polishing elements, each polishing element comprising:

a plurality of individual posts, each individual post comprising:

an individual surface that forms a portion of a polishing surface of the polishing pad; and one or more sidewalls extending downwardly from the individual surface, wherein each polishing element of the plurality of polishing elements has a width of 5 mm or less, and the sidewalls of the plurality of individual posts define a plurality of pores between adjacent individual posts of the plurality of individual posts, each pore of the plurality of pores having a width of 120 μm or less.

18. The method of claim 17, wherein the plurality of pores are interconnected.

19. The method of claim 17, wherein at least one pore extends completely across each polishing element of the plurality of polishing elements and connects to the plurality of grooves on opposite sides of the each polishing element of the plurality of polishing elements.

20. The method of claim 17, wherein a width of each pore of the plurality of pores is less than a width of each groove of the plurality of grooves, and wherein a depth of each pore of the plurality of pores is about equal to a depth of each groove of the plurality of grooves.

* * * * *